US005453028A

United States Patent [19]

Grambley et al.

[11] Patent Number: 5,453,028

[45] Date of Patent: Sep. 26, 1995

[54] ELECTRICAL CONNECTOR

[75] Inventors: Ken Grambley, Elburn; Arvind Patel, Naperville; Daniel M. Prescott, Wayne/W. Chicago; Jack Schafer, LaGrange; Charles T. Walsh, Elgin, all of Ill.

[73] Assignee: Molex Incorporated, Lisle, Ill.

[21] Appl. No.: 241,383

[22] Filed: May 11, 1994

[51] Int. Cl.[6] ..... H01R 4/24

[52] U.S. Cl. ..... 439/441; 439/839

[58] Field of Search ..... 439/338–341, 439/696, 701, 885, 80–83, 839

[56] References Cited

U.S. PATENT DOCUMENTS

| | | | |
|---|---|---|---|
| 1,948,309 | 2/1934 | Neumann | 439/438 |
| 2,883,641 | 4/1959 | Despard | 439/438 |
| 3,671,924 | 6/1992 | Nagano | 439/440 |
| 3,867,004 | 2/1975 | Komorowski et al. | 439/441 |
| 4,333,231 | 6/1982 | Yeargin | 29/764 |
| 4,566,748 | 1/1986 | Tanishi et al. | 339/95 D |
| 4,978,315 | 12/1990 | Edgley et al. | 439/441 |
| 5,174,784 | 12/1992 | Penning | 439/439 |

FOREIGN PATENT DOCUMENTS

| | | |
|---|---|---|
| 0469350A2 | 7/1991 | European Pat. Off. . |
| 04109563 | 4/1992 | Japan . |

*Primary Examiner*—David L. Pirlot
*Attorney, Agent, or Firm*—Stephen Z. Weiss

[57] ABSTRACT

An electrical connector includes a dielectric housing having a terminal-receiving passage for insertion thereinto of a terminal. The terminal includes a cantilevered spring contact arm projecting into the passage for engagement by an appropriate conductor inserted into the passage. The terminal further includes an engagement arm projecting into the passage behind the cantilevered spring contact arm at a location to perform the dual function of providing an anti-overstress engagement surface for the spring contact arm and providing an engagement shoulder for an insertion tool which forces the terminal into the terminal-receiving passage of the housing. The passage is open-ended to allow the conductor to be inserted completely through the housing past the contact arm of the terminal and into the clearance hole of the printed circuit board.

11 Claims, 2 Drawing Sheets

ELECTRICAL CONNECTOR

FIELD OF THE INVENTION

This invention generally relates to the art of electrical connectors and, particularly, to an electrical connector system which includes a unique terminal configuration along with other cooperative components such as a connector housing for facilitating miniaturization of the connector.

BACKGROUND OF THE INVENTION

Generally, electrical connectors include a dielectric housing mounting a plurality of conductive terminals for making electrical connection between a pair of electrical devices. For instance, an electrical connector may interconnect a conductor of an electrical wire to a circuit trace on a printed circuit board. Electrical connectors have been provided in a myriad of designs and constructions.

The electrical terminals of such connectors also are provided in a myriad of different configurations. For instance, every terminal must have a contact portion or portions for engaging the electrical device or devices to which the terminal is terminated or between which the terminal is interconnected. For instance, the contact portion may be a flexible spring contact arm. The terminal most often includes a base portion which is provided for mounting the terminal in the connector housing. The terminal may include a latching portion for retaining the terminal in the housing. The terminal may include a tail portion projecting from the housing. Quite often, the terminal includes a portion that is engageable by an insertion tool for inserting the terminal into the housing. All of these various components of electrical terminals must be considered in designing a particular electrical connector, and the sheer number of such components or portions of the terminal constantly create problems in electrical connector design.

For instance, in the every-increasing miniaturization of electrical connectors for compact design of electronic apparatus, the connectors and, in turn, the terminals must be provided in smaller and smaller design envelopes. Critical portions of the terminal, such as the contact portions thereof, end up being located very near the mating face or the terminating face of the connector housing itself. Therefore, it is desirable, and the present invention is directed, to providing components of an electrical terminal that can perform dual functions, such as the functions described above.

In addition, the present invention is directed to a unique combination of a connector housing which is surface mounted on a printed circuit board to allow "over-insertion" of a conductor through the housing and into the printed circuit board.

SUMMARY OF THE INVENTION

An object, therefore, of the invention is to provide a new and improved electrical connector and an electrical connector system of the character described.

In the exemplary embodiment of the invention, the connector includes a dielectric housing having a terminal-receiving passage for insertion thereinto of a terminal in a given insertion direction. The terminal includes a flexible cantilevered spring contact arm projecting into the passage for engagement by an appropriate conductor inserted into the passage. The invention contemplates that the terminal include an engagement arm projecting into the passage behind the cantilevered spring contact arm at a location to perform the dual function of providing an anti-overstress engagement means for the spring contact arm and providing an engagement shoulder for an insertion tool which forces the terminal into the terminal-receiving passage of the housing.

As disclosed herein, the terminal is a unitary structure of stamped and formed sheet metal material. The engagement arm is formed by a blade-like element projecting in a plane generally transversely of the given insertion direction to thereby present a planar surface for engagement by the insertion tool and an edge surface for engagement by the cantilevered spring contact arm. The contact arm forms one leg of a generally U-shaped portion of the terminal, and the engagement arm projects toward the spring contact arm from the other leg of the generally U-shaped portion of the terminal.

Another feature of the invention is directed to miniaturizing the connector, whereby the contact portion of the terminal is very near a terminating face of the housing. The terminal-receiving passage is open-ended with a first open end in a mating face of the housing for receiving the conductor and with a second open end in the terminating face of the housing and through which the conductor can extend past the contact portion of the spring contact arm.

The invention also contemplates an electrical connector system wherein the terminating end of the connector housing is surface mounted to a printed circuit board. The circuit board has a clearance hole aligned with the second open end of the terminal-receiving passage. Therefore, the conductor can be inserted completely through the housing past the contact portion of the terminal and into the clearance hole in the printed circuit board.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
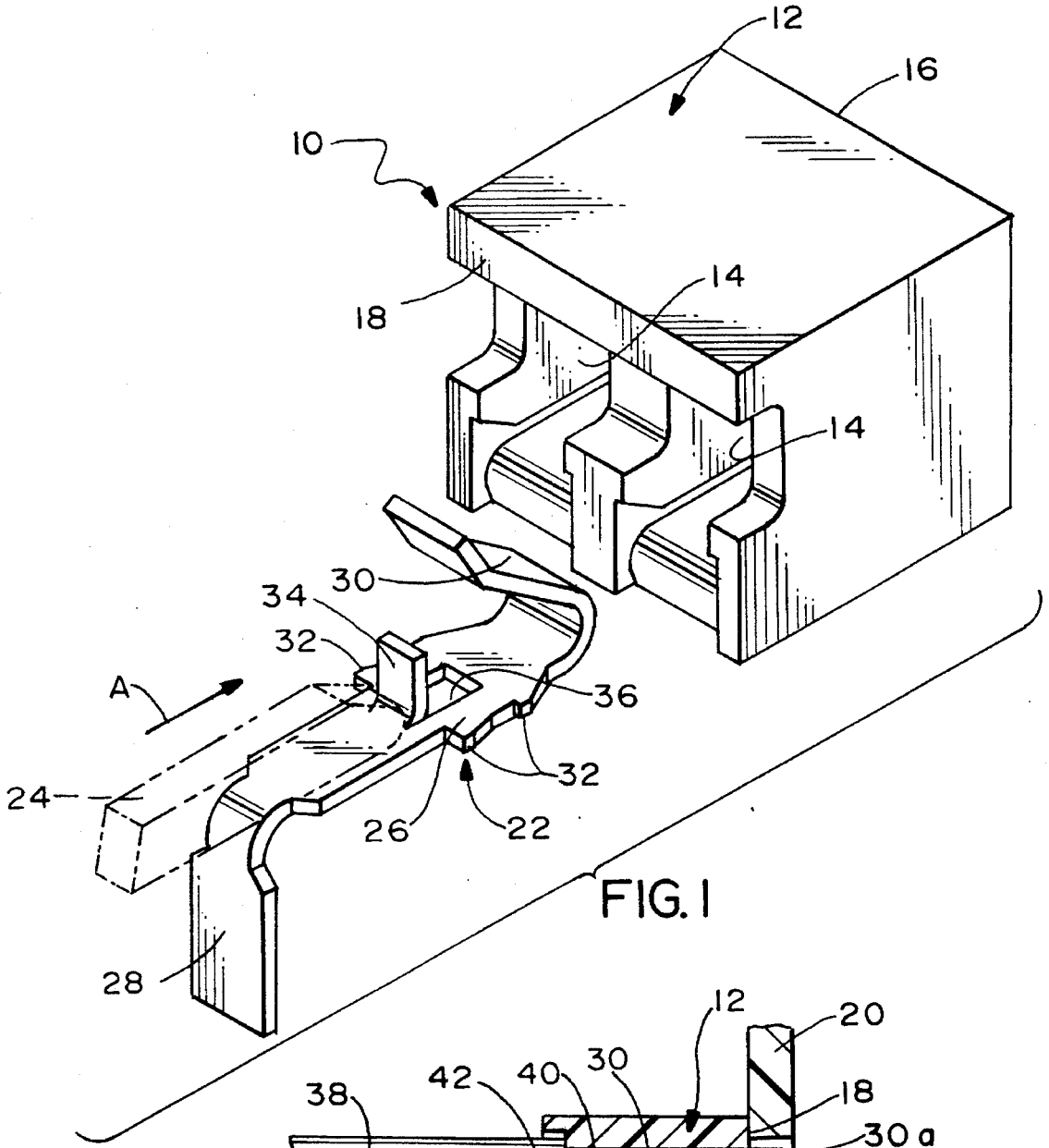
FIG. 1 is a perspective view of one embodiment of an electrical connector, showing the dielectric housing of the connector and one terminal of the connector being inserted into the housing.
Figure 2:
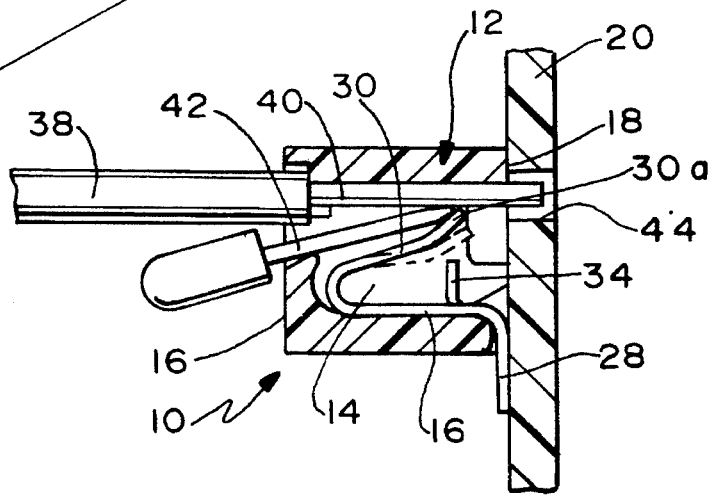
FIG. 2 is a vertical section showing the connector of FIG. 1 receiving a conductor, with a terminating face of the connector surface mounted to a printed circuit board, and with a release tool inserted into the connector.

Referring to the drawings in greater detail, and first to FIGS. 1 and 2, one embodiment of an electrical connector, generally designated 10, incorporates the concepts of the present invention and includes a dielectric housing, generally designated 12, which has a plurality of terminal-receiving passages 14. The housing is unitarily molded of insulating material such as plastic or the like and defines a mating end or face 16 and a terminating end or face 18. Connector 10 is adapted for surface mounting to a printed circuit board 20 as shown in FIG. 2 and described hereinafter.

Connector 10 includes a plurality of terminals, generally designated 22, designed for insertion into passages 14 in the direction of arrow "A" (FIG. 1) by an insertion tool 24 shown in phantom. Although a connector design for two terminals 22 and two passages 14 are shown in the drawings, it is contemplated that the concepts of the invention are applicable for use in electrical connectors having from one to a plurality of terminals more than two thereof.

Connector 10 is configured as a type of "wire trap" connector, and each terminal 22 is stamped and formed of sheet metal material and includes a base or body portion 26 having a tail portion 28 at one end and a cantilevered spring contact arm 30 at the opposite end. It can be seen in FIG. 1 that tail portion 28 is formed perpendicular to base portion 26 for surface connection to an appropriate circuit trace on printed circuit board 20 as shown in FIG. 2. Spring contact arm 30 is reverse formed back over base portion 26 whereby the base portion and the spring contact arm form a generally U-shaped portion of the terminal within the respective passage, again as clearly seen in FIG. 2. Terminal 22 also is formed with a pair of teeth 32 at each edge of base portion 26 for biting into the plastic material of housing 12 at each side of the respective terminal-receiving passage 14. Lastly, terminal 22 includes an engagement arm 34 stamped and formed out of an opening 36 in base portion 26, such that the engagement arm projects transversely of passage 14 behind cantilevered spring contact arm 30.

Engagement arm 34 of each terminal 22 is unique in that it is located to perform a dual function. First, referring to FIG. 1, it can be seen that the engagement arm is a blade-like element in a plane generally transverse to arrow "A" which defines the insertion direction of the terminal. Therefore, insertion tool 24 can be engaged with the engagement arm to force the terminal into its respective passage 14 in housing 12.

Second, referring to FIG. 2, engagement arm 34 is shown located behind and projecting toward cantilevered spring contact arm 30. An electrical wire 38 with an exposed conductor 40 is shown inserted into passage 14 and into engagement with a contact portion or tip **30*a* of contact arm 30. The tip of the contact arm traps the conductor and prevents its withdrawal. A release tool 42 is shown inserted into passage 14 for releasing the spring contact arm away from conductor 40 and allow removal of the conductor. There is a tendency for an operator to overbias the spring contact arm and, in turn, overstress the arm and destroy some of the resiliency thereof. The location of engagement arm 34** provides an anti-overstress means for the spring contact arm.

Therefore, it can be seen from the above that engagement arm 34 projects into passage 14 behind cantilevered spring contact arm 30 at a location to perform the dual function of (1) providing an anti-overstress engagement means for the spring contact arm, and (2) providing an engagement shoulder for an insertion tool 24 which forces terminal 22 into the terminal-receiving passage of housing 12.

Another feature of the invention is shown in FIG. 2 wherein it can be seen that passage 14 is open-ended and includes open ends in both the mating face 16 and the terminating face 18 of connector housing 12. Therefore, conductor 40 can be cut to a length to extend completely through the passage. In addition, a system is provided for including a clearance hole 44 in printed circuit board 20 and into which conductor 40 can project beyond the connector.

It should be understood that it is very difficult to cut exposed conductors 40 to precise lengths. Consequently, heretofore the connector housing had to be made sufficiently large to accommodate a substantial length of the conductor therewithin, in order to ensure that the conductor would be properly terminated to the contact arm of the terminal. With the system of the invention, by providing passage 14 as an open-ended passage, spring contact arm 30 can be located near one end or face of the housing, such as terminating face 18, and conductor 40 simply can be cut to a substantial length and project entirely through the housing. Further, the system contemplates that the printed circuit board, itself, include clearance hole 44 to allow the over-insertion of the conductor. This entire concept allows connector housing 12 to be miniaturized at least in the dimension thereof between mating and terminating faces 16 and 18, respectively.

Figure 3:
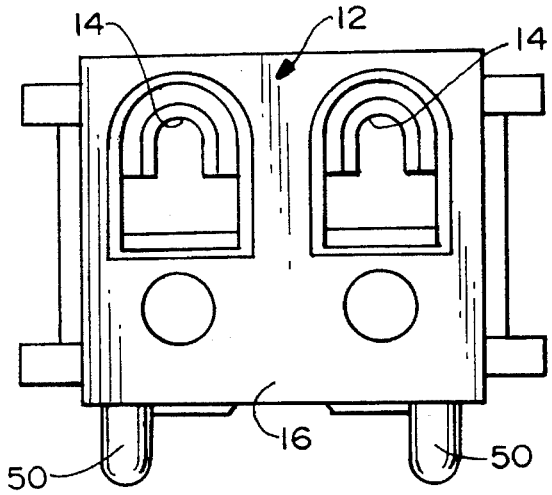
FIG. 3 is a front elevational view of another embodiment of an electrical connector for surface mounting to a printed circuit board at a right-angle to the embodiment of FIGS. 1 and 2.
Figure 4:
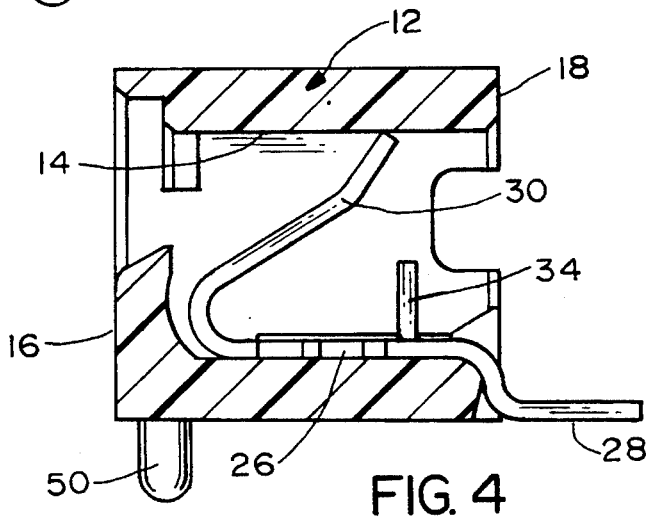
FIG. 4 is a vertical section through the connector of FIG. 3.
Figure 5:
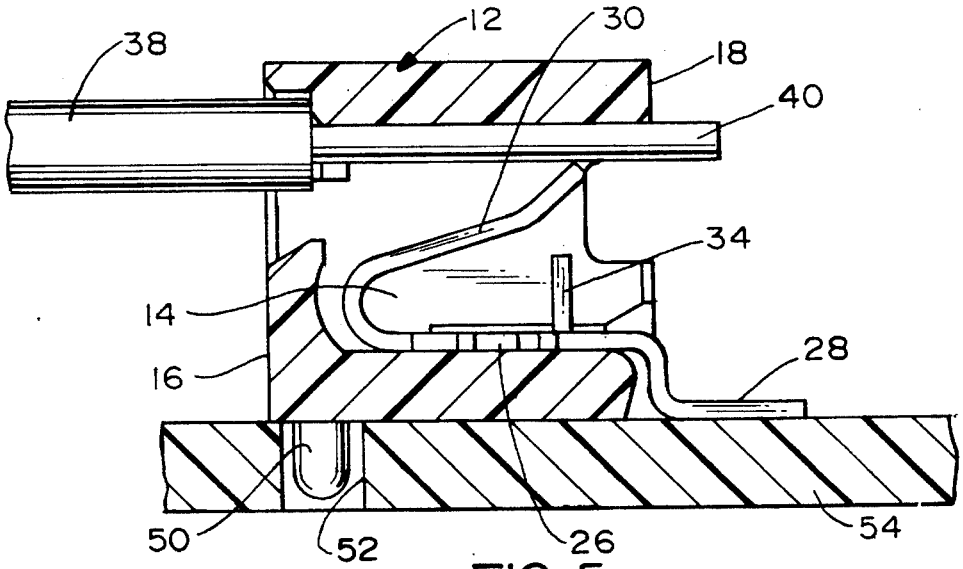
FIG. 5 is a view similar to that of FIG. 4, with the connector mounted to a printed circuit board, and with a conductor inserted into the connector.

FIGS. 3–5 show an alternate embodiment of the invention which is very similar to the embodiment described above in relation to FIGS. 1 and 2. Consequently, like reference numerals have been applied in FIGS. 3–5 corresponding to like elements or components described above in FIGS. 1 and 2.

More particularly, in the embodiment of FIGS. 3–5, the connector housing 12 includes a plurality of mounting feet 50 for mounting within a plurality of mounting holes 52 in a printed circuit board 54. It can be seen that the connector in FIGS. 3–5 is mounted to the printed circuit board at a right-angle relative to the connector shown in FIG. 2.

The only other difference in the connector of FIGS. 3–5 is that the terminals each include a tail portion 28' which is formed for surface mounting to printed circuit board 54 in the right-angled orientation of the connector. In other words, whereas tail portion 28 (FIGS. 1 and 2) projects perpendicular to base portion 26 of the terminal, tail portion 28' (FIGS. 4 and 5) is offset from and extends generally parallel to base portion 26. Otherwise the configuration of the terminal, including cantilevered spring contact arm 30 and engagement arm 34 is identical to terminal 22 described above.

In the embodiment of FIGS. 3–5, like the embodiment of FIGS. 1 and 2, terminal-receiving passages 14 are open-ended so that conductors 40 can be inserted completely through the connector housing as shown in FIG. 5. Therefore, again, contact arm 30 of the terminal can be located very near terminating face 18 of the housing without creating a problem of ensuring that the conductor actually engages the contact arm, since the conductor can be cut to a length to extend considerably beyond the contact arm.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector which includes a dielectric housing having a terminal-receiving passage for insertion thereinto of a terminal in a given insertion direction, the terminal including a cantilevered spring contact arm projecting into the passage for engagement by an appropriate conductor inserted into the passage, said terminal including an engagement arm projecting into the passage behind the cantilevered spring contact arm at a location to perform the dual function of providing an anti-overstress engagement means for the spring contact arm and providing an engagement shoulder for an insertion tool which forces the terminal into the terminal-receiving passage of the housing.

2. In an electrical connector as set forth in claim 1, wherein said engagement arm comprises a blade-like element projecting in a plane generally transversely of said given insertion direction.

3. In an electrical connector as set forth in claim 1, wherein said passage is open-ended with one open end aligned with the spring contact arm for receiving the conductor and with an opposite end aligned with the engagement arm for receiving the insertion tool.

4. In an electrical connector as set forth in claim 1, wherein said housing has a mating face and a terminating face, said cantilevered spring contact arm has a contact portion near the terminating face of the housing, and said passage is open-ended with a first open end in the mating face of the housing for receiving the conductor and with a second open end in the terminating face of the housing and through which the conductor can extend past the contact portion of the spring contact arm.

5. In an electrical connector as set forth in claim 1, wherein said passage is an open-ended passage through the housing whereby the conductor can be inserted completely through the housing and into a clearance hole in a printed circuit board to which the connector is mounted.

6. In an electrical connector as set forth in claim 1, wherein said terminal comprises a unitary structure of stamped and formed sheet metal material.

7. In an electrical connector as set forth in claim 6, wherein said engagement arm comprises a blade-like element projecting in a plane generally transversely of said given insertion direction to thereby present a planar surface for engagement by the insertion tool and an edge surface for engagement by the cantilevered spring contact arm.

8. In an electrical connector as set forth in claim 1, wherein said cantilevered spring contact arm forms one leg of a generally U-shaped portion of the terminal, and said engagement arm projects toward the spring contact arm from the other leg of the generally U-shaped portion of the terminal.

9. In an electrical connector as set forth in claim 8, wherein said passage is open-ended with one open end aligned with the spring contact arm for receiving the conductor and with an opposite end aligned with the engagement arm for receiving the insertion tool.

10. A wire trap connector for connecting the stripped end of a conductor to a printed circuit board, said connector including a housing having a conductor receiving opening at one end, a terminal receiving opening at another end, and a cavity extending between the conductor and terminal receiving openings, a portion of the cavity leading from the terminal receiving opening defining a terminal receiving region and a portion of the cavity leading from the conductor receiving opening defining a conductor receiving region adjacent the terminal receiving region, and a terminal mounted in the terminal receiving region through the terminal receiving opening, said terminal having a base portion, a flexible cantilevered spring arm extending from the base portion into the conductor receiving region in order to electrically engage a conductor received therein, the improvement comprising:

an anti-overstress tab extending from the base portion towards the conductor receiving region between said spring arm and said base portion to prevent said arm from traveling too far towards the base portion in response to the insertion of a conductor into the conductor receiving region, said tab including a tool engaging surface facing the terminal receiving opening adapted for engagement with an insertion tool in order to facilitate insertion of the terminal into the terminal receiving region of the cavity.

11. In an electrical connector system which includes a dielectric connector housing having a mating face and an opposite terminating face adapted to be surface mounted to a printed circuit board, a terminal-receiving passage in the connector housing and having an open end in the mating face of the housing for insertion thereinto of an appropriate conductor, a terminal received in the passage and having a contact portion for engagement by the inserted conductor, wherein the improvement comprises said passage having a second open end in the terminating face of the housing, and a clearance hole in the printed circuit board aligned with the second open end of the passage, whereby the contact portion of the terminal can be located near the terminating face of the housing and the conductor can be inserted completely through the housing past the contact portion and into the clearance hole in the printed circuit board.

* * * * *